US010759215B1

(12) United States Patent
Ramsey Orr

(10) Patent No.: US 10,759,215 B1
(45) Date of Patent: Sep. 1, 2020

(54) SAMPLE STORAGE ASSEMBLY

(71) Applicant: Korina Ramsey Orr, Montbello, CO (US)

(72) Inventor: Korina Ramsey Orr, Montbello, CO (US)

( * ) Notice: Subject to any disclaimer, the term of this patent is extended or adjusted under 35 U.S.C. 154(b) by 0 days.

(21) Appl. No.: 16/683,782

(22) Filed: Nov. 14, 2019

(51) Int. Cl.

| | |
|---|---|
| ***B42F 7/06*** | (2006.01) |
| ***B42F 7/08*** | (2006.01) |
| ***B42F 19/04*** | (2006.01) |
| ***B42F 13/26*** | (2006.01) |
| ***B42F 5/00*** | (2006.01) |
| ***B42F 13/00*** | (2006.01) |

(52) U.S. Cl.
CPC ..... *B42F 13/26* (2013.01); *B42F 5/00* (2013.01); *B42F 7/06* (2013.01); *B42F 7/08* (2013.01); *B42F 13/0006* (2013.01); *B42F 19/04* (2013.01)

(58) Field of Classification Search
CPC ..... B42F 19/04; B42F 7/06; B42F 7/08
USPC ..... 402/79
See application file for complete search history.

(56) References Cited

U.S. PATENT DOCUMENTS

| | | | | |
|---|---|---|---|---|
| 1,352,728 A * | 9/1920 | Delaney | B42F 19/04 | 40/124.4 |
| 2,254,893 A * | 9/1941 | Hires | 40/124 | |
| 4,345,394 A * | 8/1982 | Sullivan | B42F 5/00 | 40/124.2 |
| 5,316,404 A * | 5/1994 | Hensel | B42D 5/00 | 40/721 |
| 6,045,160 A * | 4/2000 | Weeks | B42D 3/04 | 281/29 |
| 6,155,738 A * | 12/2000 | King | G09F 5/04 | 206/455 |
| 6,390,714 B1 * | 5/2002 | Bradley | B42F 5/005 | 281/38 |
| 6,632,042 B1 | 10/2003 | Liener Chin | | |
| 6,652,178 B2 * | 11/2003 | Walton | B42F 21/02 | 281/38 |
| 6,694,650 B2 * | 2/2004 | Brown | G09F 1/10 | 40/124.2 |
| D741,197 S | 10/2015 | Sam | | |
| 2002/0067865 A1 | 6/2002 | Stutzman | | |
| 2004/0005100 A1 | 1/2004 | Versluys | | |
| 2013/0202226 A1 | 8/2013 | Hartztield | | |
| 2014/0064823 A1 | 3/2014 | Benefield | | |
| 2019/0308439 A1 * | 10/2019 | Tefenlili | B42F 7/06 | |

* cited by examiner

*Primary Examiner* — Kyle R Grabowski

(57) ABSTRACT

A sample storage assembly for storing a plurality of sample packets includes a sheet that is positionable in a three ring binder for storing the sheet. A plurality of pockets is each coupled to the sheet to insertably receive a sample packet. Each of the pockets is expandable or collapsible to contain a varying number of the sample packets. A plurality of elastomeric bands is each coupled to the sheet. Each of the elastomeric bands is aligned with respective ones of the pockets. Each of the sample packets is extendable beneath a respective one of the elastomeric bands. In this way each of the elastomeric bands inhibits the sample packets from falling out of the pockets.

5 Claims, 4 Drawing Sheets

SAMPLE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing a plurality of sample packets.

(2) Description of Related Art Including Information Disclosed Under 37 CFR 1.97 and 1.98

The prior art relates to storage devices. The prior art, generally speaking, discloses a sheet with a plurality of pouches coupled thereto for storage purposes. In each instance a perimeter edge of the pouches is fixed to the sheet such that the pouches have a fixed volume. A variety of closures is disclosed for closing the pouches.

BRIEF SUMMARY OF THE INVENTION

An embodiment of the disclosure meets the needs presented above by generally comprising a sheet that is positionable in a three ring binder for storing the sheet. A plurality of pockets is each coupled to the sheet to insertably receive a sample packet. Each of the pockets is expandable or collapsible to contain a varying number of the sample packets. A plurality of elastomeric bands is each coupled to the sheet. Each of the elastomeric bands is aligned with respective ones of the pockets. Each of the sample packets is extendable beneath a respective one of the elastomeric bands. In this way each of the elastomeric bands inhibits the sample packets from falling out of the pockets.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
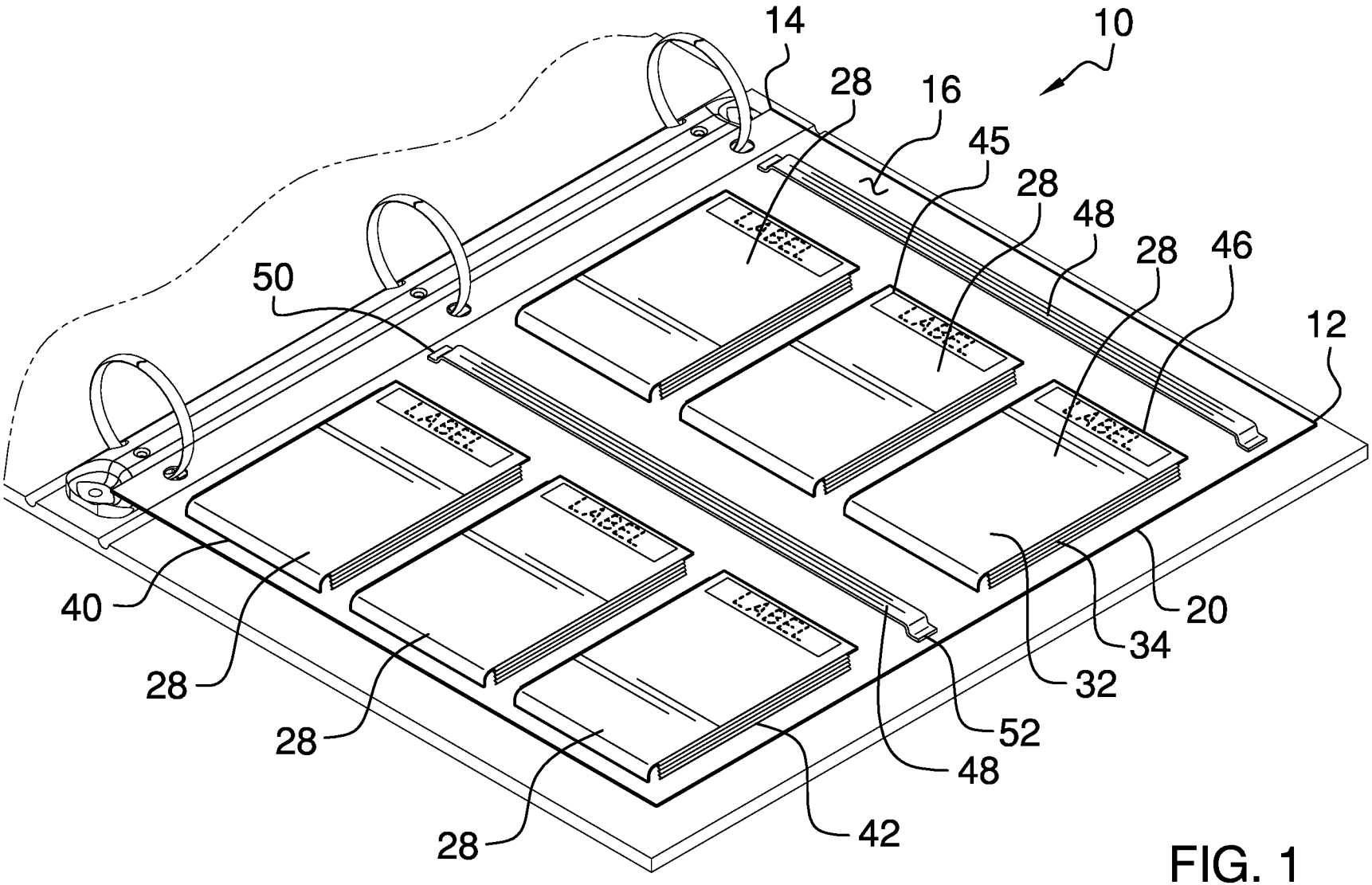
FIG. 1 is a front perspective view of a sample storage assembly according to an embodiment of the disclosure.
Figure 2:
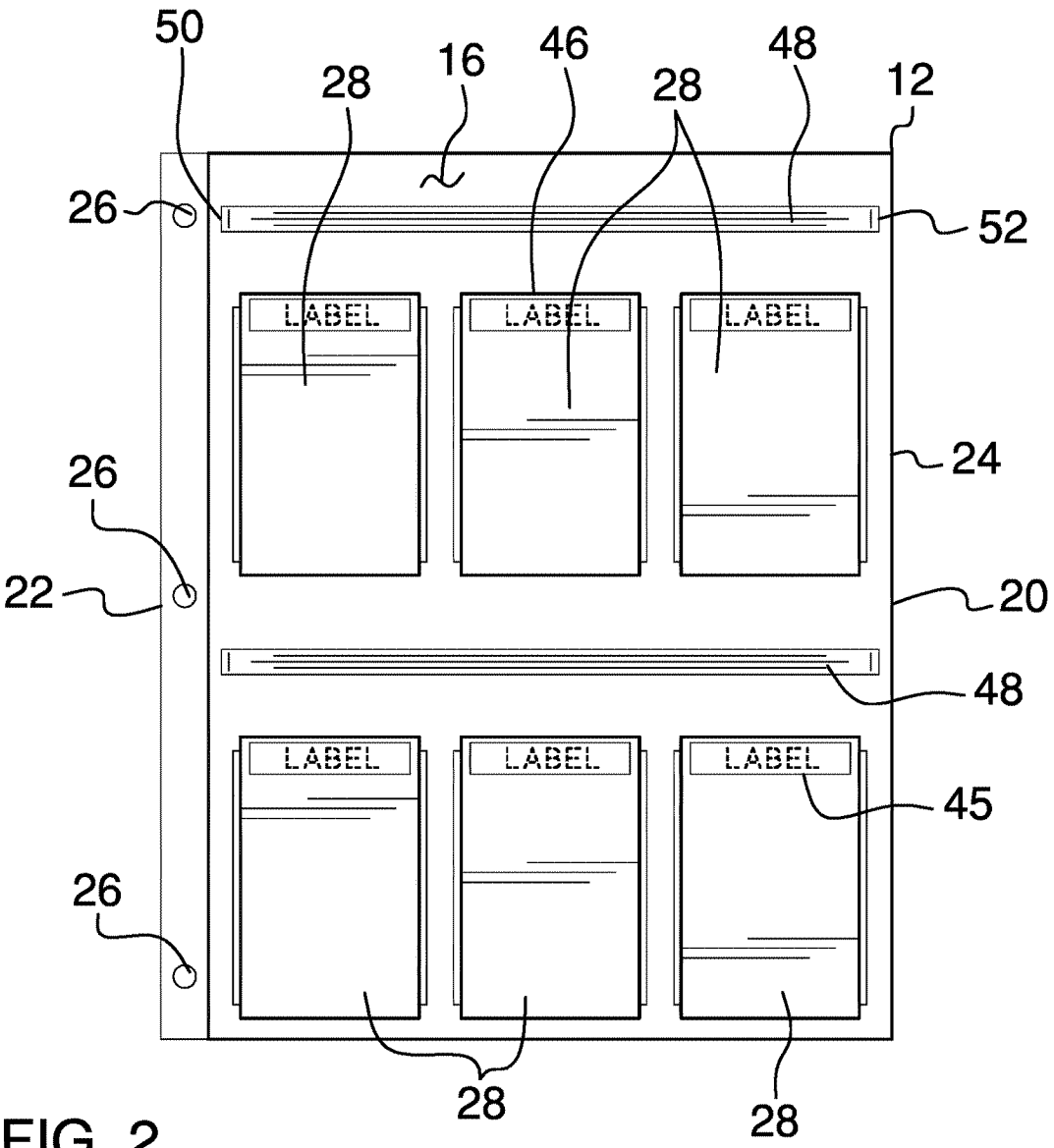
FIG. 2 is a front view of an embodiment of the disclosure.
Figure 4:
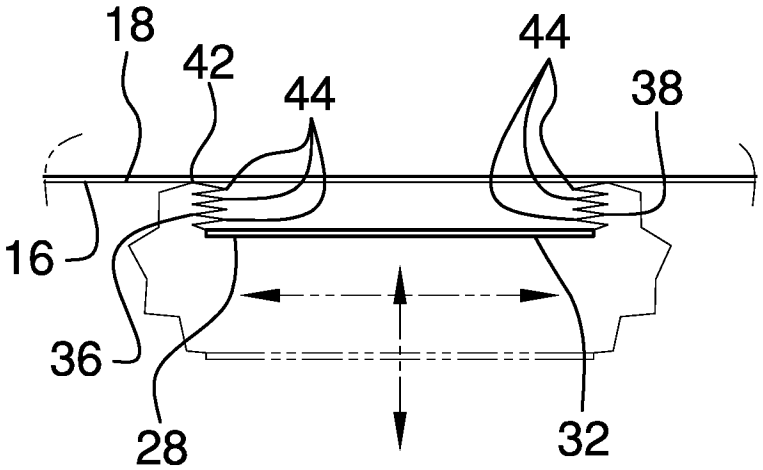
FIG. 4 is a top view of an embodiment of the disclosure.
Figure 3:
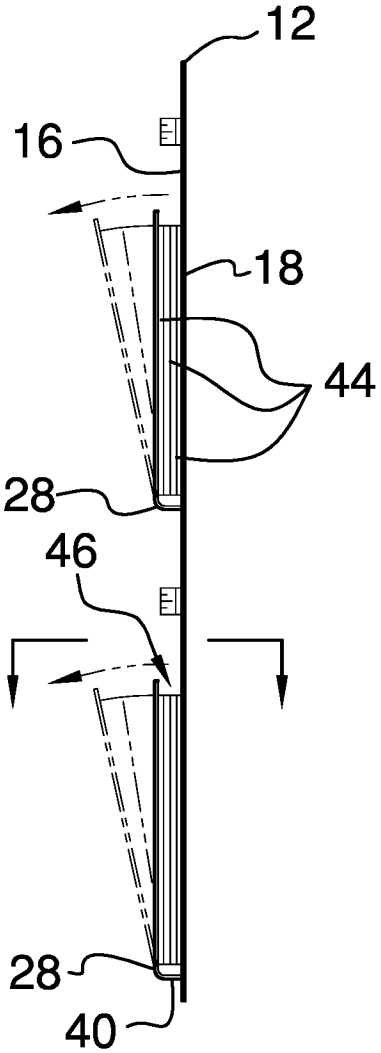
FIG. 3 is a right side view of an embodiment of the disclosure.
Figure 5:
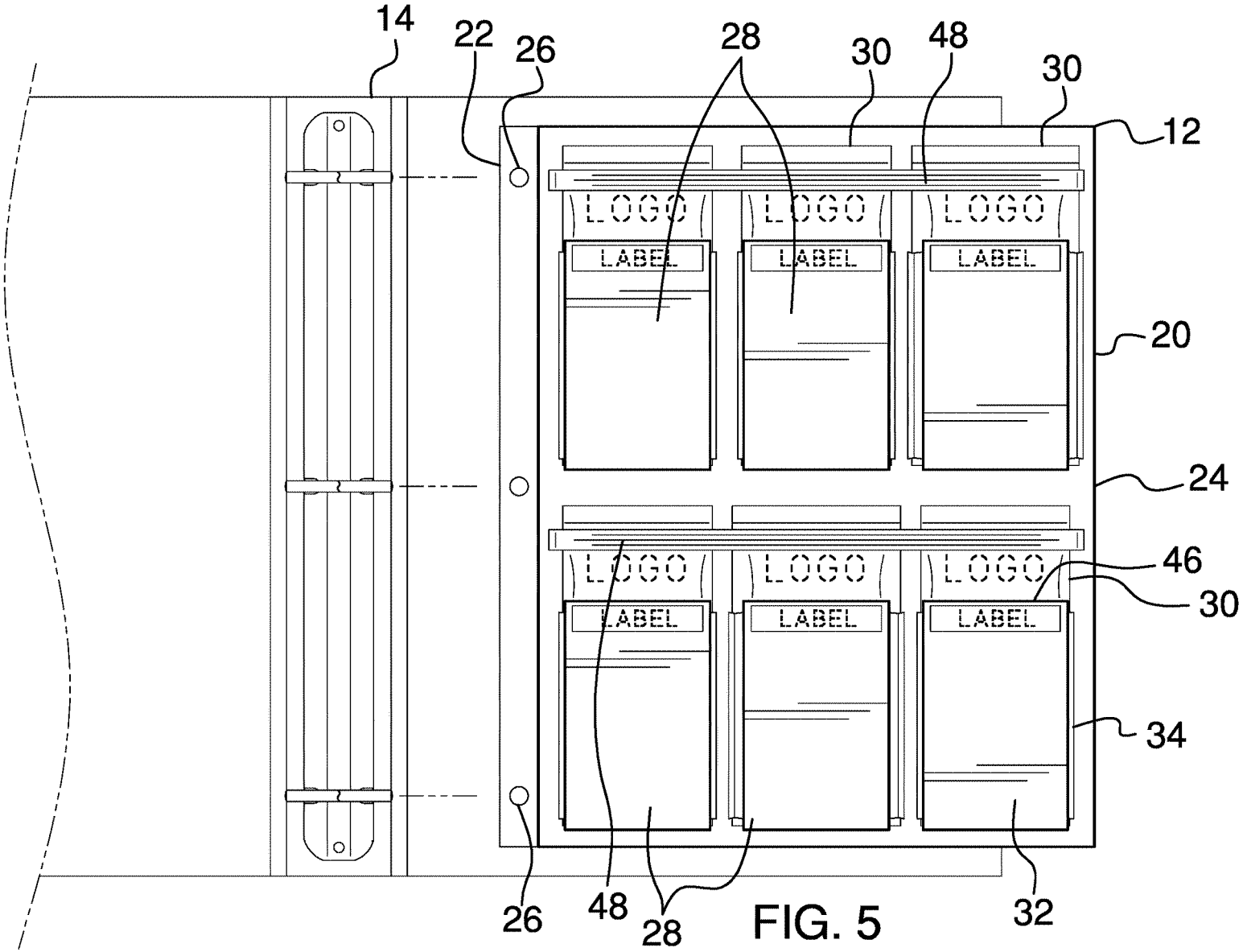
FIG. 5 is a perspective in-use view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the sample storage assembly 10 generally comprises a sheet 12 has that is positionable in a three ring binder 14 for storing the sheet 12. The sheet 12 has a first surface 16, a second surface 18 and a perimeter edge 20, and the perimeter edge 20 has a first lateral side 22 and a second lateral side 24. The sheet 12 has a plurality of openings 26 extending through the first surface 16 and the second surface 18. Each of the openings 26 is positioned adjacent to the first lateral side 22 and the openings 26 are spaced apart from each other and are distributed along the first lateral side 22. The sheet 12 may have dimensions that are common to three ring binders.

A plurality of pockets 28 is each coupled to the sheet 12 to insertably receive a sample packet 30. The sample packet 30 may be shampoo sample or other packet that contains a sample amount of a variety of products. Each of the pockets 28 is expandable or collapsible such that each of the pockets 28 can contain a varying number of the sample packets 30. In this way a plurality of the sample packets 30 can be stored on the sheet 12 in an organized fashion.

Each of the pockets 28 has a front wall 32 and a perimeter wall 34, and the perimeter wall 34 has a first lateral side 36, a second lateral side 38 and a bottom side 40. Additionally, the perimeter wall 34 has a distal edge 42 with respect to the front wall 32. Each of the first lateral side 36 and the second lateral side 38 of the perimeter wall 34 has a plurality of pleats 44 that are distributed between the distal edge 42 and the front wall 32 such that the pleats 44 are expandable or collapsible. A label 45 is attached to the front wall 32 of each of the pockets 28 for labeling the contents of each pocket 28. The distal edge 42 is coupled to the first surface 16 of the sheet 12 such that the front wall 32 is spaced from the first surface 16. In this way a top end 46 of each of the pockets 28 is defined that is open for insertably receiving the sample packets 30. The front wall 32 of each pocket 28 can be angled between a minimum distance and a maximum distance from the first surface 16. Additionally, the plurality of pockets 28 is arranged into a plurality of columns and rows on the sheet 12.

A plurality of elastomeric bands 48 is provided and each of the elastomeric bands 48 is coupled to the sheet 12. Each of the elastomeric bands 48 is aligned with respective ones of the pockets 28. Each of the sample packets 30 is extendable beneath a respective one of the elastomeric bands 48 when the sample packets 30 are positioned in the pockets 28. In this way each of the elastomeric bands 48 inhibits the sample packets 30 from falling out of the pockets 28.

Each of the elastomeric bands 48 has a first end 50 and a second end 52. Each of the first end 50 and the second end 52 of each of the elastomeric bands 48 is coupled to the first surface 16 of the sheet 12. Additionally, each of the elastomeric bands 48 is oriented to extend between the first lateral side 22 and the second lateral side 24 of the perimeter edge 20. Each of the elastomeric bands 48 is spaced from the top end 46 of respective ones of the pockets 28.

In use, the sheet 12 is positioned in the three ring binder 14 for storage and transportation. Each of the sample packets 30 is positioned in a respective one of the pockets 28 for storage. Additionally, the sample packets 30 are positioned beneath the respective elastomeric band 48. In this way the sample packets 30 are inhibiting from falling out of the pockets 28 during transportation. Additionally, the pockets 28 can be expanded to accommodate an increasing number of the sample packets 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sample storage assembly being configured to contain a plurality of samples within a three ring binder, said assembly comprising:

a sheet being positionable in a three ring binder for storing said sheet, said sheet having a first surface, a second surface and a perimeter edge, said perimeter edge having a first lateral side and a second lateral side, said sheet having a plurality of openings extending through said first surface and said second surface, each of said openings being positioned adjacent to said first lateral side, said openings being spaced apart from each other and being distributed along said first lateral side;

a plurality of pockets, each of said pockets being coupled to said sheet wherein each of said pockets is configured to insertably receive a sample packet, each of said pockets being expandable or collapsible wherein each of said pockets is configured to contain a varying number of the sample packets each of said pockets having a front wall and a perimeter wall, said perimeter wall having a first lateral side, a second lateral side and a bottom side, said perimeter wall having a distal edge with respect to said front wall, each of said first lateral side and said second lateral side of said perimeter wall having a plurality of pleats being distributed between said distal edge and said front wall such that said pleats are expandable or collapsible; and a plurality of elastomeric bands, each of said elastomeric bands being coupled to said sheet, each of said elastomeric bands being aligned with associated ones of said pockets spaced from open ends of each of the associated ones of said pockets wherein said elastomeric bands are configured such that each of the sample packets are positionable extending beneath a respective one of said elastomeric bands wherein each of said elastomeric bands is configured to inhibit the sample packets from falling out of said pockets and wherein each the elastomeric band extend across a plurality of said pockets.

2. The assembly according to claim 1, wherein said distal edge is coupled to said first surface of said page such that said front wall is spaced from said first surface thereby defining a top end of each of said pockets being open for insertably receiving the sample packets, said front wall being tiltable between a minimum distance and a maximum distance from said first surface.

3. The assembly according to claim 2, wherein said plurality of pockets is arranged into a plurality of columns and rows on said sheet.

4. The assembly according to claim 2, wherein each of said elastomeric bands has a first end and a second end, each of said first end and said second end of each of said elastomeric bands being coupled to said first surface of said sheet, each of said elastomeric bands being oriented to extend between said first lateral side and said second lateral side of said perimeter edge, each of said elastomeric bands being spaced from said top end of respective ones of said pockets.

5. A sample storage assembly being configured to contain a plurality of samples within a three ring binder, said assembly comprising:

a sheet being positionable in a three ring binder for storing said sheet, said sheet having a first surface, a second surface and a perimeter edge, said perimeter edge having a first lateral side and a second lateral side, said sheet having a plurality of openings extending through said first surface and said second surface, each of said openings being positioned adjacent to said first lateral side, said openings being spaced apart from each other and being distributed along said first lateral side;

a plurality of pockets, each of said pockets being coupled to said sheet wherein each of said pockets is configured to insertably receive a sample packet, each of said pockets being expandable or collapsible wherein each of said pockets is configured to contain a varying number of the sample packets, each of said pockets having a front wall and a perimeter wall, said perimeter wall having a first lateral side, a second lateral side and a bottom side, said perimeter wall having a distal edge with respect to said front wall, each of said first lateral side and said second lateral side of said perimeter wall having a plurality of pleats being distributed between said distal edge and said front wall such that said pleats are expandable or collapsible, said distal edge being coupled to said first surface of said page such that said front wall is spaced from said first surface thereby defining a top end of each of said pockets being open for insertably receiving the sample packets, said front wall being tiltable between a minimum distance and a maximum distance from said first surface, said plurality of pockets being arranged into a plurality of columns and rows on said sheet; and a plurality of elastomeric bands, each of said elastomeric bands being coupled to said sheet, each of said elastomeric bands being aligned with associated ones of said pockets spaced from open ends of each of the associated ones of said pockets wherein said elastomeric bands are configured such that each of the sample packets are positionable beneath a respective one of said elastomeric bands wherein each of said elastomeric bands is configured to inhibit the sample packets from falling out of said pockets, each of said elastomeric bands having a first end and a second end, each of said first end and said second end of each of said elastomeric bands being coupled to said first surface of said sheet, each of said elastomeric bands being oriented to extend between said first lateral side and said second lateral side of said perimeter edge, each of said elastomeric bands being spaced from said top end of respective ones of said pockets and wherein each the elastomeric band extend across a plurality of said pockets.

* * * * *